US007566220B1

(12) United States Patent
Thompson

(10) Patent No.: US 7,566,220 B1
(45) Date of Patent: Jul. 28, 2009

(54) MODULAR PROPANE GAS LOG BURNER

(75) Inventor: Matthew A. Thompson, Tulsa, OK (US)

(73) Assignee: Hargrove Manufacturing Corporation, Sand Springs, OK (US)

( * ) Notice: Subject to any disclaimer, the term of this patent is extended or adjusted under 35 U.S.C. 154(b) by 682 days.

(21) Appl. No.: 11/214,442

(22) Filed: Aug. 29, 2005

(51) Int. Cl.
*F23D 14/62* (2006.01)

(52) U.S. Cl. ..... 431/354; 431/8; 431/12; 431/125; 126/512

(58) Field of Classification Search ..... 431/354, 431/8, 12, 125, 126; 126/512, 91 R, 92 AC, 126/92 R
See application file for complete search history.

(56) References Cited

U.S. PATENT DOCUMENTS

| | | | | |
|---|---|---|---|---|
| 4,838,241 | A | | 6/1989 | Rieger |
| 4,930,490 | A | | 6/1990 | Allan |
| 4,940,407 | A | | 7/1990 | Rehberg et al. |
| 5,320,520 | A | | 6/1994 | Barth et al. |
| 5,399,084 | A | | 3/1995 | McCullough et al. |
| 5,452,709 | A | | 9/1995 | Mealer |
| 5,591,024 | A | | 1/1997 | Eavenson et al. |
| 5,722,824 | A | * | 3/1998 | Beck ..... 431/125 |
| 5,786,045 | A | | 7/1998 | Gerth et al. |
| 5,918,592 | A | | 7/1999 | Kazubski et al. |
| 5,927,270 | A | * | 7/1999 | McDonald ..... 126/512 |
| 5,988,159 | A | | 11/1999 | Blount |
| 6,036,474 | A | | 3/2000 | Diep et al. |
| 6,095,794 | A | | 8/2000 | Jamieson et al. |
| 6,260,548 | B1 | | 7/2001 | Wade |
| 6,383,421 | B1 | | 5/2002 | Phipps |
| 6,390,808 | B1 | | 5/2002 | Cakebread |
| 6,805,115 | B2 | | 10/2004 | Campbell et al. |

* cited by examiner

*Primary Examiner*—Alfred Basichas
(74) *Attorney, Agent, or Firm*—Molly D. McKay

(57) ABSTRACT

The present invention relates to a modular propane gas log burner for use in fireplaces that were originally designed as wood burning fireplaces. The present burner is designed for clean burning of propane fuel and is modular so that more than one burner can be used in combination in order to create a burner configuration for wider single-sided gas log sets, for deeper single-sided gas log sets, and for two-sided or see-through gas log sets. The burner is provided with means for adjusting the fuel-to-air ratio and for adjusting the position of the flames to allow the user to achieve realistic and clean burning flames.

2 Claims, 5 Drawing Sheets

MODULAR PROPANE GAS LOG BURNER

BACKGROUND OF THE INVENTION

1. Field of the Invention

The present invention relates to a modular propane gas log burner for use in fireplaces that were originally designed to burn solid fuel such as wood. The present burner is designed for clean burning of propane fuel and is modular so that more than one burner can be used in combination in order to create a burner configuration for wider single-sided gas log sets, for deeper single-sided gas log sets, and for two-sided or see-through gas log sets.

2. Description of the Related Art

Prior art sand pan type gas log burners do not burn cleanly when operating on propane or LP gas. The incomplete combustion of the LP gas by these types of gas log burners results in unsightly carbon deposits on the artificial logs. The reason for the dirty burning is that the higher molecular density of LP gas makes it more difficult to raise the flame temperatures to the point where carbon deposits are eliminated. Prior art sand pan burners are not able to produce these elevated flame temperatures necessary to produce a clean burning flame.

Also, because LP gas is generally delivered to a burner through an air mixing device that is located after the orifice, the medium used to cover sand pan type burners tends to block the flow of the LP gas and thus prevents the LP gas from flowing freely from the burner.

The present invention addresses these problems by providing a burner that is specially designed to burn cleanly on LP gas. The invention has a top burner plate with strategically placed and shaped ports and an un-sealed burner plenum. The invention also employs an LP gas orifice and air shutter. Together these structures produce a clean burning flame that simulates a real wood fire.

Also, the present burner does not employ the heavier medium used to cover sand pan type burners. The only covering that the present burner employs is a thin covering of glass wool that allows for free passage of the LP gas there through and which glows in a manner similar to the glow of hot embers as the LP gas burns above the glass wool.

The orifice and ports of the present burner are tuned to produce a realistic yellow flame that reaches flame temperatures in excess of 800 degrees C. in order to eliminate excess carbon buildup usually associated with decorative gas burners operating on LP gas.

In addition, this invention provides a modular base so that several configurations can be created by using multiple modules. The modular design allows for expanding the size of sets operating on LP gas. The configurations that are possible include wider single-sided gas log sets, deeper single-sided gas log sets, and two-sided or see-through gas log sets. The interconnectivity is integral to the design and allow for these expanded sets to be operated with a single safety pilot control valve. These options were not previously possible or feasible using prior art burners.

One of the objects of the present invention is to provide a burner that has improved combustion properties, primarily reduced carbon deposits, when compared to prior art sand pan type burners.

Another object of the present invention is to provide a modular burner design that can be used to create multiple burner configurations for wider, deeper and two-sided fireplaces.

Still a further object of the present invention is to provide a modular burner design from which multiple burner configurations can be created employing a single safety pilot control valve.

SUMMARY OF THE INVENTION

The present invention is a modular propane gas log burner designed for use in fireplaces that were originally designed as wood burning fireplaces. The present burner is designed for clean burning of propane fuel and is modular so that more than one burner can be used in combination in order to create a burner configuration for wider single-sided gas log sets, for deeper single-sided gas log sets, and for two-sided or see-through gas log sets. The present invention is designed to produce a realistic looking flame around the artificial gas logs and is provided with means for adjusting the location of the flames and adjusting the air-to-fuel ratio to achieve the optimum flame placement and fuel combustion.

DETAILED DESCRIPTION OF THE PREFERRED EMBODIMENT THE INVENTION

Figure 1:
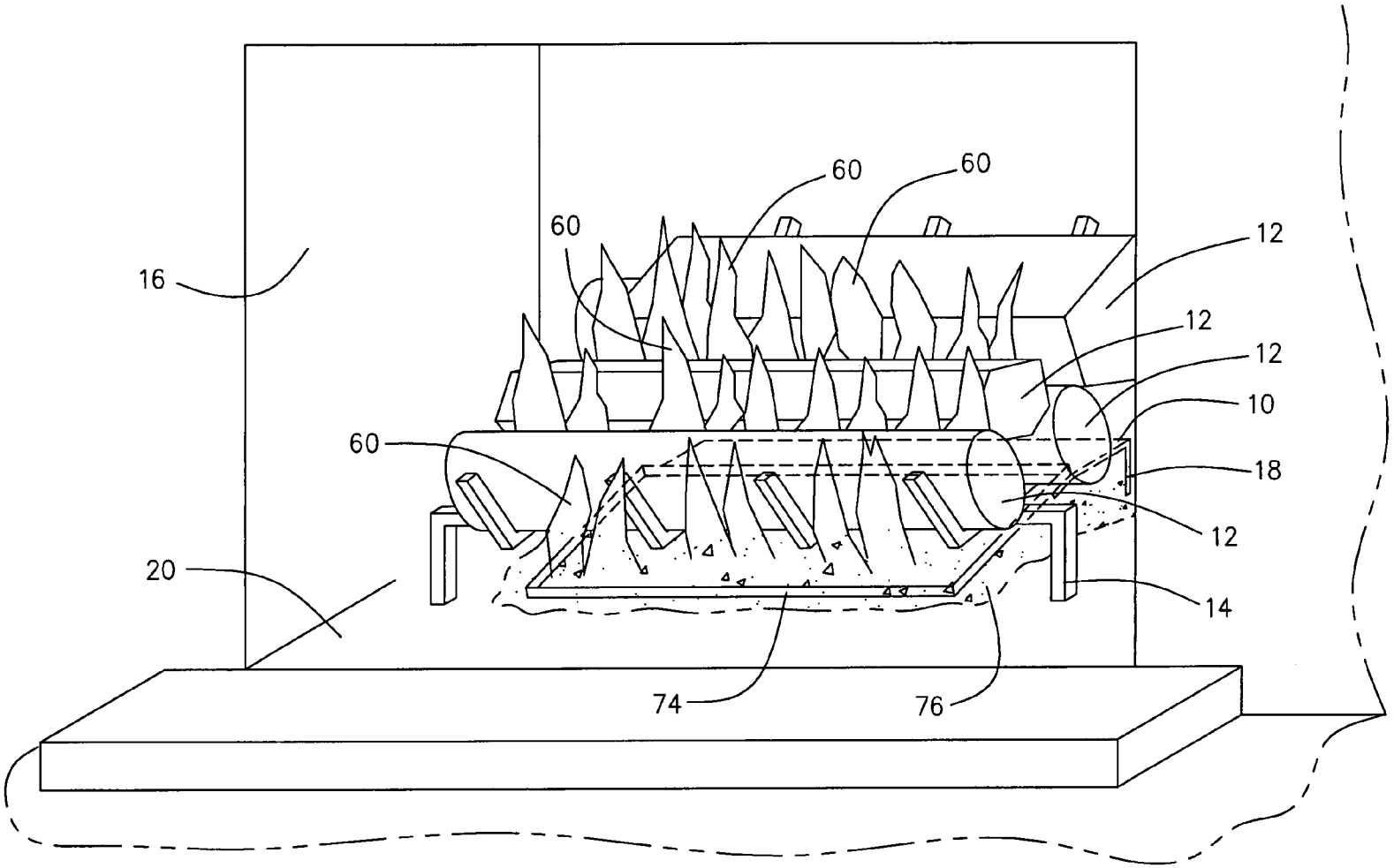
FIG. 1 is a perspective view of a fireplace employing a modular propane gas log burner constructed in accordance with a preferred embodiment of the present invention. The modular propane gas log burner is shown in outline under artificial gas logs located within the firebox of the fireplace.
Figure 8:
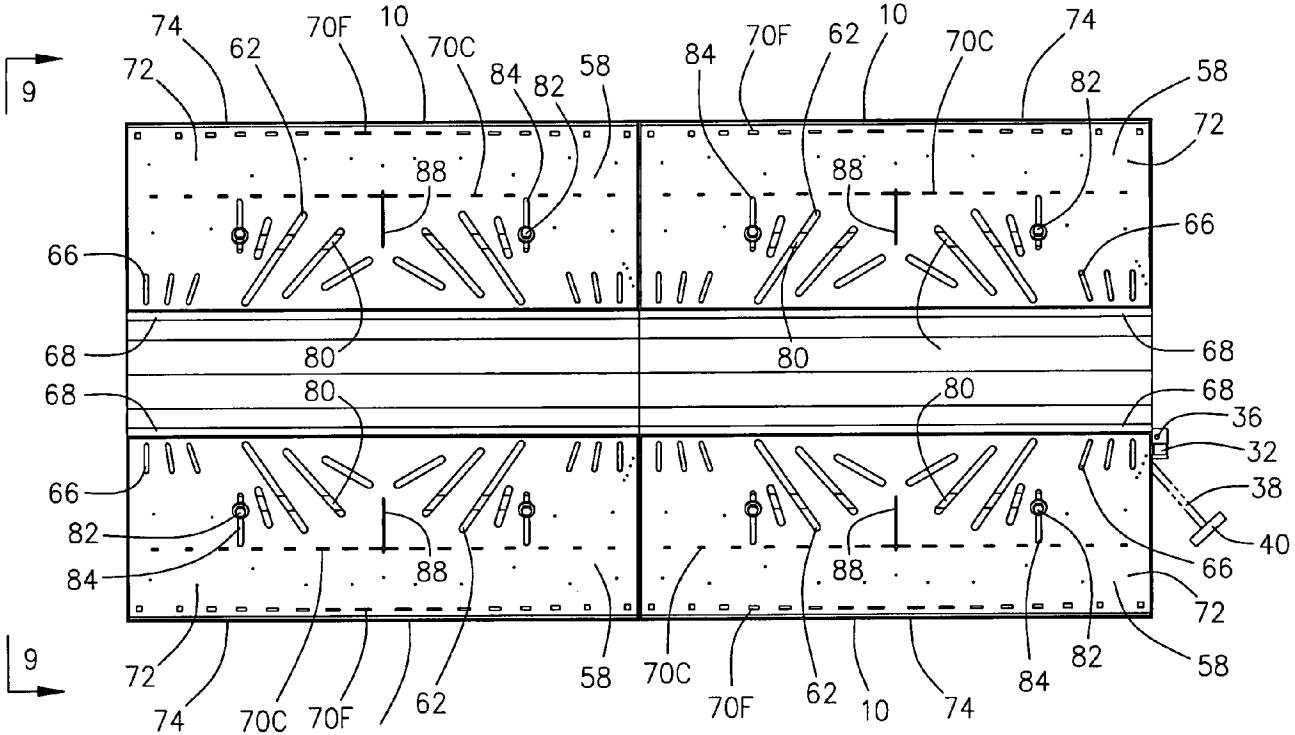
FIG. 8 is a top plan view of a back-to-back and wider gas log set configuration constructed of four burners that is suitable for use in a two-sided or see-through fireplace that is also wider than normal fireplaces.
Figure 10:
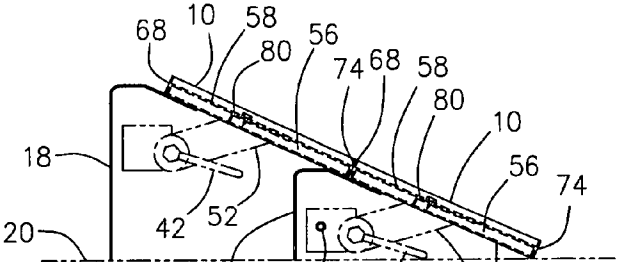
FIG. 10 is a left side view of an alternate two burner stacked gas log set configuration for use in deeper single-sided fireplaces.
Figure 9:
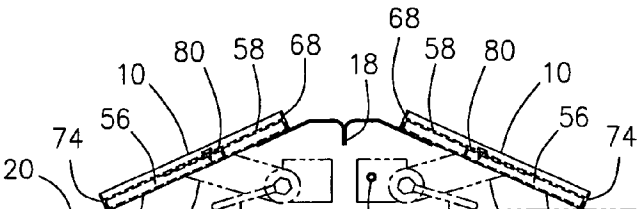
FIG. 9 is a left side view of the four burner back-to-back gas log set configuration of FIG. 8 taken along line 9-9.

Referring now to the drawings and initially to FIG. 1, there is illustrated a modular propane gas log burner 10 that is constructed in accordance with a preferred embodiment of the present invention. The burner 10 is shown in use with artificial logs 12 sitting on a grate 14 in a fireplace 16 that was originally designed as a wood burning fireplace. As will be more fully described hereafter, the burner 10 is designed for clean burning of propane or LP gas fuel. Also, as illustrated in FIGS. 8-10, the burner 10 is of a modular design so that more than one burner 10 can be used in combination in order to create a burner configuration for wider single-sided gas log sets, for deeper single-sided gas log sets, and for two-sided or see-through gas log sets.

Referring now to FIGS. 2-7, the construction of the burner 10 will be described. Beginning with FIG. 7, the LP gas enters the burner 10 via an LP gas supply line 22. The LP gas line is provided with a pressure regulator 24 that maintains the LP gas at a constant pressure as it is delivered to the burner 10. The LP gas supply line 22 delivers the LP gas to a gas valve 26. Attached to the gas valve 26 is a small gas line 30 that provides LP gas from the inlet end 28 to a pilot light 32 located at one end 34R of the burner 10. A thermocouple 36 is provided adjacent to the pilot light 32 and is connected to an inlet end 28 of the gas valve 26 via thermocouple connection 37. The thermocouple 36 senses heat from the flame of the pilot light 32 and communicates with the gas valve 26 via connection 37 to stop the flow of LP gas to the burner 10 in the event that the flame at the pilot light 32 is extinguished.

The gas valve 26 is provided with a valve stem 38 that extends beyond the side 34R of the burner 10 so that a knob 40 provided on the valve stem 38 can be turned by the user in order to operate the valve 26 once the burner 10 is installed in a fireplace 16. When the valve stem 38 is turned to open the gas valve 26, this allows LP gas to flow through the gas valve 26 and into a gas delivery line 42. The structures described to this point are all standard structures found in most gas log burners.

Figure 7:
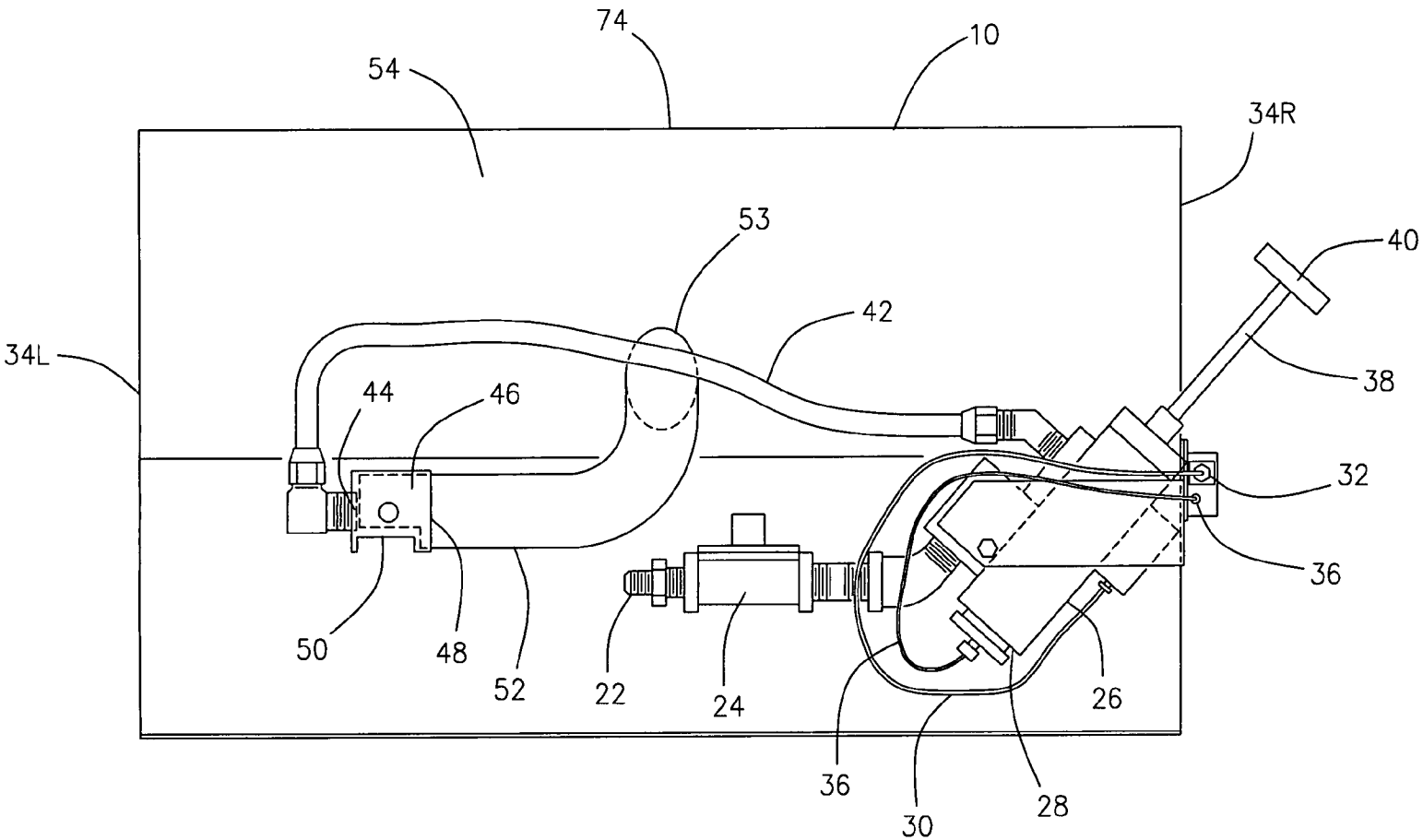
FIG. 7 is a bottom plan view of the burner taken along line 7-7 of FIG. 4.

As illustrated in FIG. 7, the gas delivery line 42 is attached to an LP gas orifice 44 and an adjustable air shutter 46. The LP gas orifice 44 creates a jet of LP gas that flows through the air shutter 46. The air shutter 46 is provided with a rotatable sleeve 48 that has an air opening 50 provided therein. As the jet of LP gas passes through the air shutter 46, it creates a vacuum that pulls air into the gas stream via the air opening 50 of the sleeve 48. By rotating the sleeve 48, the air opening 50 is either increased or decreased in size thereby resulting in either an increase or decrease in the amount of air that enters the air shutter 46. The gas jet and air that enters through the air shutter 46 mix together and travel through an enlarged burner gas line 52. The enlarged burner gas line 52 is attached to a bottom pan 54 of the burner 10 and opens centrally into an unsealed burner plenum 56 that is formed between the bottom pan 54 of the burner 10 and a mating top burner plate 58 of the burner 10.

Figure 4:
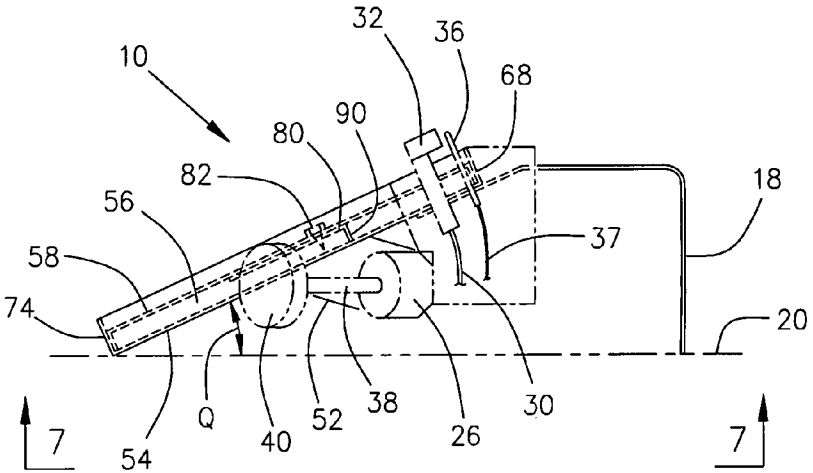
FIG. 4 is a right side view of the burner taken along line 4-4 of FIG. 2.
Figure 3:
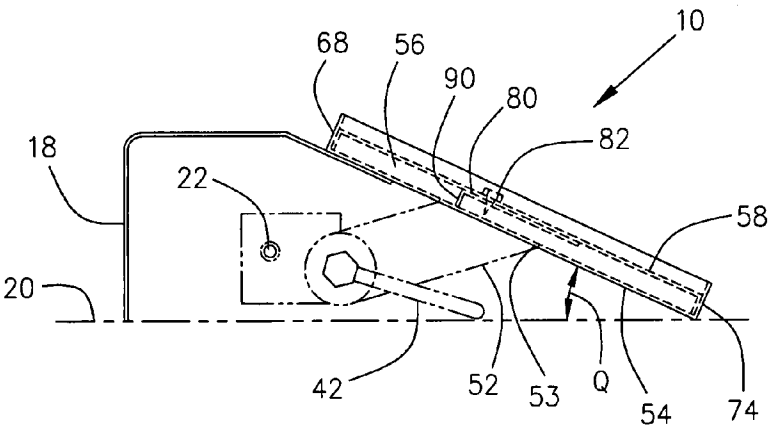
FIG. 3 is a left side view of the burner taken along line 3-3 of FIG. 2.

As shown in FIGS. 3 and 4, the burner 10 is provided with a rear leg 18 that attaches to the bottom pan 54 and holds the burner 10 at an angle Q with the surface 20 on which the burner 10 is supported. As illustrated in FIG. 10, the rear leg 18 can be lengthened to allow the burners 10 to be stacked.

Once the LP gas stream enters the burner plenum 56, the gas strikes the top burner plate 58 which causes the gas to be diverted toward the two ends 34R and 34L of the burner 10. As illustrated in FIG. 1, in order for the LP gas to produce a realistic flame, larger flames 60 should to be produced around the logs 12 centrally above the burner 10. To achieve this, the top burner plate 58 must have slots or openings provided there through so that the LP gas can escape from the burner plenum 56 upward through the slots or openings in the top burner plate 58. Because the LP gas tends to travel within the plenum 56 to the ends 34R and 34L of the burner 10, it is necessary to have a plurality of enlarged slots 62 located centrally in the top burner plate 58 so that the majority of the gas will exit the top burn plate 58 via these enlarged slots 62 to produce larger flames 60 in the desired central area of the burner 10. These enlarged slots 62 are preferably provided at an angle to the flow path of the LP gas so that as the LP gas exits through the enlarged slots 62 and is burned, the flames 60 produced appear to be extending along the entire horizontal aspect of the logs 12, as shown in FIG. 1.

Also, because some of the gas will travel within the plenum 56 to the ends 34R and 34L of the burner 10, end slots 66 are also provided in the top burner plate 58 at the ends 34R and 34L of the burner 10 so that there are flames 60 produced along the logs 12 above the entire length of the burner 10. The end slots 66 are preferably considerably smaller than the enlarged slots 62 provided centrally in the top burner plate 58. All of the enlarged and end slots 62 and 66 are located adjacent to the upper or back side 68 of the top burner plate 58. The upper or back side 68 of the top burner plate 58 is located on a raised side of the sloped burner 10, i.e. the side where the rear leg 18 is attached to the burner 10.

In addition to the enlarged slots 62 and the end slots 66 provided in the upper side 68 of the top burner plate 58, a plurality of smaller slots 70C and 70F and smaller openings 72 are provided in the top burner plate 58. The smaller slots 70C and 70F and the majority of the smaller openings 72 are located adjacent to an opposite lower or front side 74 of the top burner plate 58. The lower or front side 74 of the top burner plate 58 is located on a lower side of the sloped burner 10, i.e. on the side opposite where the rear leg 18 is attached to the burner 10. The smaller slots 70C and 70F are arranged in two horizontal rows provided in the top burner plate 58: a central row containing slots 70C that are located just in front of the enlarged central slots 62 and the end slots 66, and a front row containing slots 70F that are located in front of the central row of slots 70C and near a front side 74 of the top burner plate 58. The smaller openings 72 are preferably smaller that the smaller slots 70C and 70F and are randomly provided in the top burner plate 58 primarily, but not exclusively, between the two rows of smaller slots 70C and 70F. Together these two rows of smaller slots 70C and 70F and the smaller openings 72 allow a small amount of LP gas to exit there through. This gas will burn as it flows up through a thin layer of glass wool 76 that is used to cover the burner 10 and will cause the glass wool 76 to glow and thus resemble a full bed of glowing wood fire embers. Collectively the location, size and orientation of the slots 62, 66, 70C and 70F and smaller openings 72 provided in the top burner plate 58 of the burner 10 contribute to the realistic looking yellow flames 60 produced by the burner 10. Those flames 60 reach temperatures in excess of 800 degrees C. which eliminates excess carbon buildup usually associated with decorative gas burners operating on LP gas.

The burner 10 is designed to produce a realistic looking and clean burning flame 60 around its associated artificial gas logs 12. Referring now again to FIG. 7, it may be necessary to adjust the air-to-fuel ratio in order to achieve the desired clean burning flame 60. This is done by rotating the sleeve 48 of the air shutter 46. Rotation of the sleeve 48 either increases or decreases the amount of air that enters through the air opening 50 of the air shutter 46 and is pushed by the gas stream into the enlarged burner gas line 52 and from there into the plenum 56 of the burner 10 via a plenum opening 53 provided in the bottom pan 54.

Figure 2:
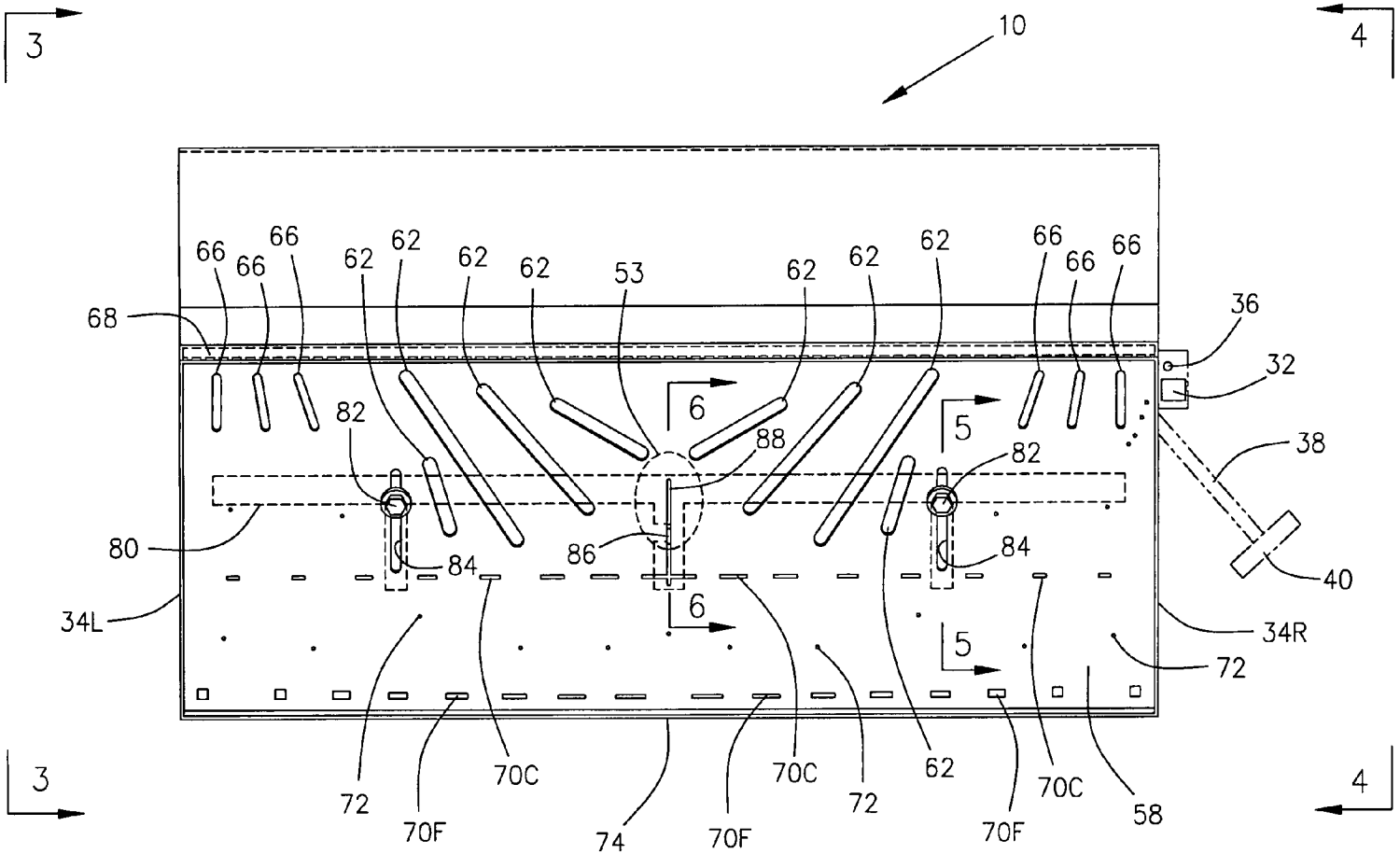
FIG. 2 is a top plan view of the modular propane gas log burner of FIG. 1 shown removed from the fireplace.
Figure 6:
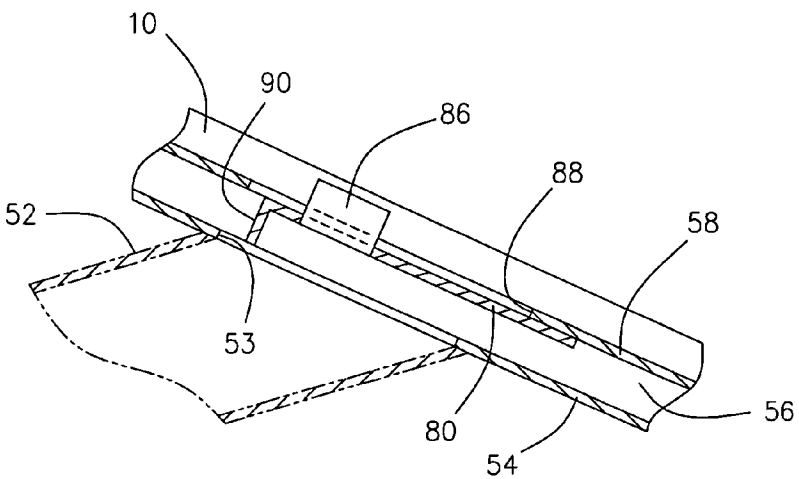
FIG. 6 is a cross sectional view of an adjustment tab provided on the adjustable slide bar taken along line 6-6 of FIG. 2.
Figure 5:
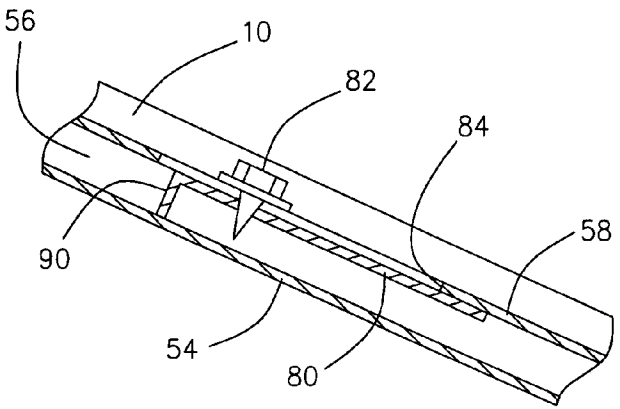
FIG. 5 is a cross sectional view of an adjustable slide bar taken along line 5-5 of FIG. 2.

Also, referring to FIGS. 2, 5, and 6, it may be necessary to move the flames 60 either forward or rearward relative to the burner 10 in order to create a realistic looking flame 60 around the artificial gas logs 12 that are positioned above the burner 10. This can be done by adjusting the position of a slide bar 80 movably provided within the plenum 56 of the burner 10. In order to adjust the position of the slide bar 80, screws 82 that secure the slide bar 80 is a given position relative to the top burner plate 58 must first be loosened. These screws 82 are shown in FIGS. 2 and 5 and extend through vertically oriented screw slots 84 provided in the top burner plate 58 as a means reversibly locking or securing the slide bar 80 in position within the burner plenum 56. Once the screws 82 are loosened, the user can then move the slide bar 80 forward or rearward within the plenum 56 by use of an adjustment tab 86 provided extending upward from the adjustable slide bar 80. The adjustment tab 86 extends through a tab slot 88 provided in the top burner plate 58. Once the slide bar 80 is in the desired position, the screws 82 are then tightened in order to again secure the slide bar 80 in position within the burner plenum 56.

The slide bar 80 has a downwardly extending lip 90, as shown in FIG. 5. By repositioning the slide bar 80 within the burner plenum 56, this causes the downwardly extending lip 90 to alter the flow of LP gas within the burner plenum 56, thereby altering the amount and location of LP gas that flows out of the enlarged slots 62. This alternation results in a relocation of the flames 60 that are produced by the burner 10. The flames 60 are either moved forward or rearward relative to the burner 10, depending on the direction that the slide bar 80 was moved. This allows the user to produce optimum flame placement around the logs 12 and contributes to a realistic appearance of the flames 60 relative to the artificial logs 12.

The burner 10 is a modular unit. As illustrated in FIGS. 8, 9, and 10, this allows the burner 10 to be used in several burn configurations by employing multiple burners 10 in various configurations. The modular design allows for expanding the size of burner sets operating on LP gas. The configurations that are possible include configurations for wider, single-sided gas log sets; configurations for deeper, single-sided gas log sets; and configurations for two-sided or see-through gas log sets. The wider single-sided gas log sets employ multiple burners 10 arranged side-by-side, as shown in the lower half of FIG. 8. The deeper single-sided gas log sets employ multiple burners 10 arranged in a stacked configuration, as shown in FIG. 10. The two-sided or see-through gas log sets employ multiple burners 10 arranged in a back-to-back configuration, as shown in FIG. 9. These types of configurations can be used together, as illustrated in FIG. 8 where a wider, two-sided or see-through gas log set is illustrated. Obviously, a deeper, two-sided or see-through gas log set would also be possible. The interconnectivity of the burner 10 is integral to the design and allows for these expanded sets to be operated with a single LP gas supply line 22, a single pressure regulator 24, a single controlling gas valve 26, and a single safety pilot light 32 and thermocouple 36, as illustrated in FIG. 8 where only a single valve stem 38, a single pilot light 32 and a single thermocouple 36 are shown in association with a four burner configuration. Thus in these types of multiple burner configurations, a single gas valve 26 will supply LP gas to air shutters 46 for each of the burners 10 employed in multiple burner configurations.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A modular propane gas log burner comprising:

a bottom pan, a mating top burner plate attached to said bottom pan so that a burner plenum is formed between the bottom pant and the top burner plate, a rear leg attached to said bottom pan at a back side of said bottom pan in order to hold the bottom pan and the top burner plate at an angle with a supporting surface on which the rear leg rest, an adjustable air shutter provided between a gas delivery line and a enlarged burner gas line, said enlarged burner gas line attached to the bottom pan so that the enlarged burner gas line is in gaseous communication with the burner plenum formed between the bottom pan and the top burner plate, said top burner plate provided with slots and openings through which gas to be burned passes to escape from the burner plenum, an adjustable slide bar provided between the bottom pan and the top burner plate so that the slide bar is located within the burner plenum and can be adjusted forward and backward to change the gas flow with the burner plenum and thus change the location of flames produced by the gas that exits through the slots and openings provided in the top burner plate.

2. A modular propane gas log burner according to claim 1 further comprising:

locking means for reversible securing the slide bar to the top burner plate.

* * * * *